United States Patent [19]

Wright

[11] Patent Number: 4,627,374

[45] Date of Patent: Dec. 9, 1986

[54] ACCESSORY FOR YACHTS

[76] Inventor: Brian L. Wright, 338 Bideford Green, Linslade, Bedfordshire, England, LU7 7TX

[21] Appl. No.: 658,039

[22] Filed: Oct. 3, 1984

Related U.S. Application Data

[63] Continuation-in-part of Ser. No. 358,350, Mar. 15, 1982, abandoned.

[30] Foreign Application Priority Data

Mar. 19, 1981 [GB] United Kingdom ..... 8108568
Jun. 15, 1981 [GB] United Kingdom ..... 8118276
Nov. 4, 1981 [GB] United Kingdom ..... 8133187

[51] Int. Cl.[4] ..... B63B 21/16

[52] U.S. Cl. ..... 114/218; 254/266; 254/369; 254/371

[58] Field of Search ..... 114/218, 221 R; 254/266, 344, 369, 371; 74/532

[56] References Cited

U.S. PATENT DOCUMENTS 982,869 1/1911 Pringle ..... 74/532
2,531,816 11/1950 Homoky ..... 254/266
4,130,079 12/1978 Rhorer ..... 440/7
4,297,963 11/1981 Beacon ..... 114/218 X
4,358,281 11/1982 Woodward ..... 114/218 X

*Primary Examiner*—Sherman D. Basinger

[57] ABSTRACT

An accessory for a yacht or a mounting device for a range of accessories has a supporting leg which is adapted to locate and key with the socket of a yacht winch. The accessory or mounting device has a locking device which releasably locks the leg in the socket and also has a clamping member which after the accessory or mounting device has been locked to the winch can be adjusted to engage the winch to take up any slackness and also to prevent rotation of the winch socket.

5 Claims, 13 Drawing Figures

ACCESSORY FOR YACHTS

This application is a continuation-in-part of Ser. No. 358,350, filed Mar. 15, 1982, now abandoned.

SUMMARY OF THE INVENTION

This invention relates to an accessory for yachts.

According to one aspect of the invention there is provided an accessory device for a yacht comprising a device not intended to form an operative part of a winch and having a supporting leg which is adapted to locate in the handle receiving socket of a winch, a locking device by which the accessory can be releasably locked in the winch and a clamping member which after said accessory has been locked to the winch can be adjusted to engage the winch and so take up any slackness in the mounting of the accessory to the winch.

According to another aspect of the invention, there is provided a mounting device capable of rigidly mounting an accessory, or one of a range of accessories, on a yacht, said mounting device having mounting means for the accessory, a supporting leg which is adapted to locate in the handle receiving socket of a winch, a locking device by which the mounting device can be releasably locked in the winch and a clamping member which after said mounting device has been locked in the winch can be adjusted to engage the winch and so take up any slackness in the mounting device to the winch.

Preferably the supporting leg keys with the handle receiving socket.

The majority of handle receiving sockets of winches are international size star sockets, and so a single size and design of supporting leg will be suitable for most yachts.

One particular advantageous accessory in accordance with the invention is a vice which can be used for carrying out repairs and other work. Up to the present it has been a problem to find a suitable and stable mounting for a vice of the conventional type. By simply adapting a vice so that it can be mounted in the handle receiving socket of a winch this problem is overcome.

The invention will now be further explained by way of example with reference to the accompanying drawings.

DETAILED DESCRIPTION

Figure 1:
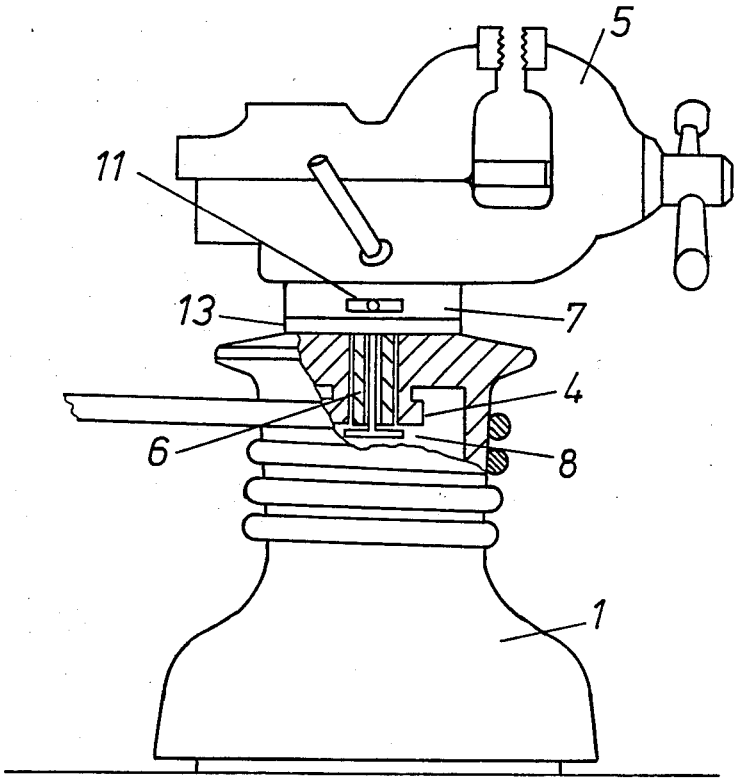
FIG. 1 shows a part-sectional side elevation of a winch with an accessory in the form of a vice mounted on it in accordance with the invention.

Referring to FIG. 1, the winch is provided with a winch handle receiving star socket 4 and a vice 5 has a downwardly extending leg 6 of square cross-section so that it locates in and keys with the star socket 4. The vice 5 is advantageously provided as a standard item which is simply bolted to a platform 7 from the underside of which leg 6 depends. Thus the platform 7 can be used as a universal platform for mounting a whole range of accessories.

Figure 4:
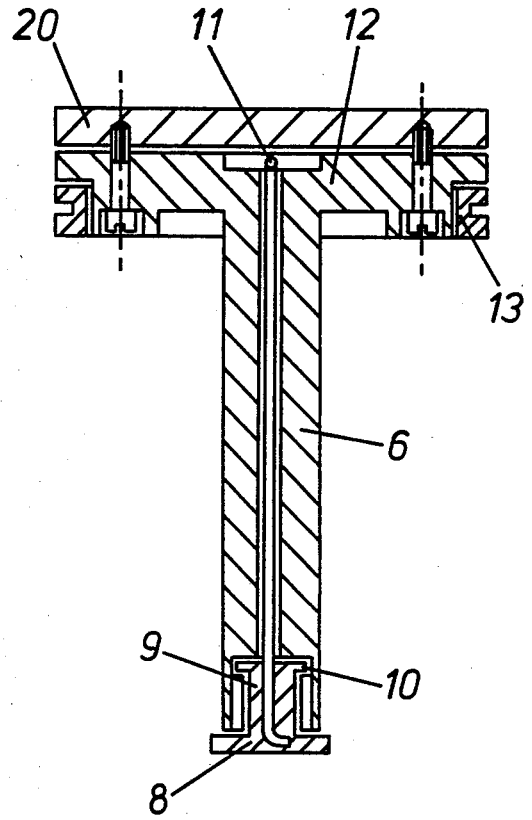
FIGS. 3 and 4 shows respectively a plan view from below and a sectional elevation of an accessory mounting device.
Figure 3:
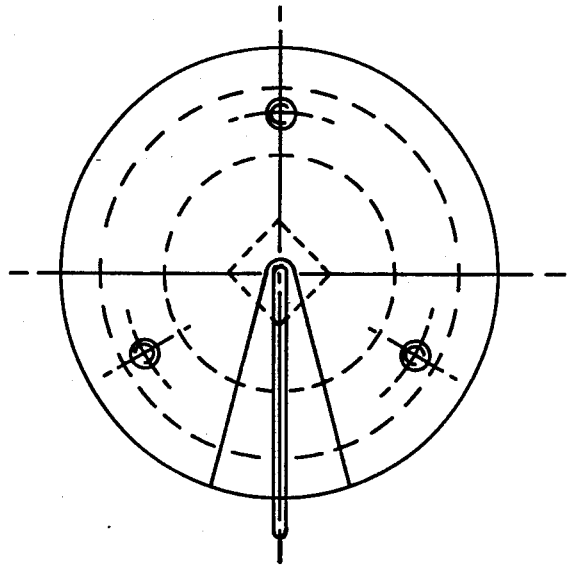

A locking arrangement is provided which releasably locks the leg 6 in the socket 4. As shown in FIGS. 3 and 4, the leg 6 is provided with a square plate 8 at its lower end of the same cross-sectional area as the leg 6. As the leg 6 is inserted into the socket with the plate edges aligned with the sides of the leg 6, the plate 8 passes right through the socket 4. Then by rotating the plate 8 so that its edges are msialigned with the sides of the leg 6 it becomes trapped behind the star socket and can not be pulled back through the socket. A clamping ring 13 as will also be described with reference to FIGS. 3 and 4 enables any slackness in the mounting of the platform 7 to be taken up and by its engagement of the top of the winch body or barrel at a position around the outside of the winch socket prevents by a frictional coupling rotation of the winch socket. This is because conventionally in winches the sockets rotate contrawise to the barrel due to the internal mechanism of the winch. Consequently, the leg 6 and clamping member 13 serve to lock up the winch.

In the platform construction shown in FIGS. 3 and 4, the platform 7 is formed by plate 12 having the integral leg 6. Plate 20 represents the general form of the bases of the various accessories that may be attached to plate 12. The plate 8 is rotatably keyed into the lower end of the leg 6. To effect this the plate 8 is provided with a cylindrical post 9 which locates in a bore in the leg 6 and which at its upper end has a pair of diametrically opposite lugs 10 which rotatably locate in an annular groove. Diametrically opposite longitudinal grooves are provided along the bore in the leg 6 along which the lugs can pass when the post 9 is pushed into the bore. It is arranged that the lugs 10 align with the grooves in the bore when the plate edges align with the sides of the leg. Hence when the edges of the plate 8 do not align with the sides of the leg the plate 8 is locked in the leg 6 by the lugs 10. The rotation of the plate is effected by a cranked wire 11 which passes down through the leg 6 and is secured to the plate 8. At its outer end the wire passes through the plate 12 and is movable through an angle defined by a slot in the plate 12 to effect rotation between aligned and misaligned positions of the plate 8 and leg 6.

To take up any slackness of the platform 7 and to provide the aforesaid rotation restraint of the winch socket, a ring 13 is threadedly mounted on plate 12. Thus after the leg 6 has been locked in position in the winch, the ring 13 can be screwed downwardly hard on to the top of the winch barrel.

In some types of winch a hole aligning with the handle receiving socket of the winch extends downwards right through the winch including the base plate through which the winch is secured to a boat.

Figure 2:
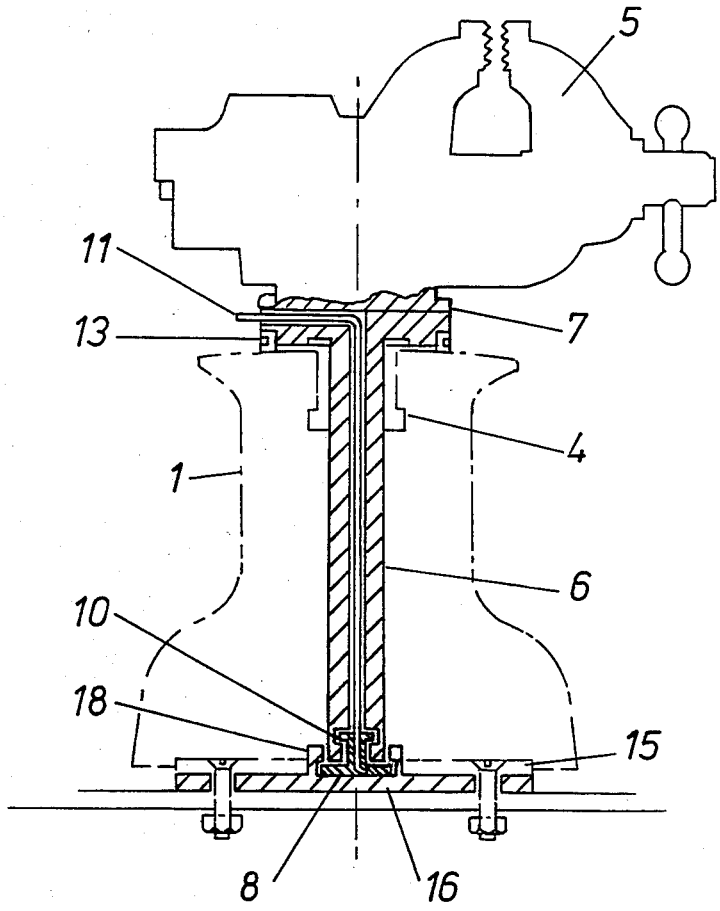
FIG. 2 shows a view similar to FIG. 1 but with a modified mounting arrangement for the vice.

In order to provide a positive rotational restraint of the winch socket, an arrangement as shown in FIG. 2 can be used. In FIG. 2 the base plate 15 of the winch 1 is shown. For mounting the platform 7 carrying vice 5 an additional plate 16 is fitted below the base plate 15 and is secured to a boat by the same fixing means used for the plate 15. The plate 16 has an upstanding annular boss 18 which locates in the central hole in the base plate 15. The hole through the boss 18 is square and receives in a close fit the leg 6, which in this arrangement is sufficiently long to extend into the boss. Thus the leg 6 and hence the platform 7 and vice 5 is held against rotation. To lock the leg 6 against being pulled upwardly out of the winch, a rotatable plate 8 identical to the plate 8 of FIGS. 3 and 4, locates in an undercut groove in the boss 18.

To facilitate the use of a standard length of leg 6 for several types and makes of winch a series of plates 16 having different height bosses can be provided. Further, several grooves at different heights can be provided in each boss.

As an alternative to providing a separate boss-carrying plate 16, boss 18 can be incorporated in the base plate 15 of the winch or elsewhere within the winch.

In addition to mounting the accessories in the winch socket, a socket device may also be provided for locating the winch handle when not in use and into which the accessories therefore locate in the same or similar manner as in the winch.

Although only a vice is shown in FIGS. 1 and 2. The invention relates to a range of accessories including for example a search light, a shower, TV aerial, bilge pump, fishing rod, VHF aerial, workbench, a table, a camera support, canopy support, a seat and a sun shade.

Figure 5:
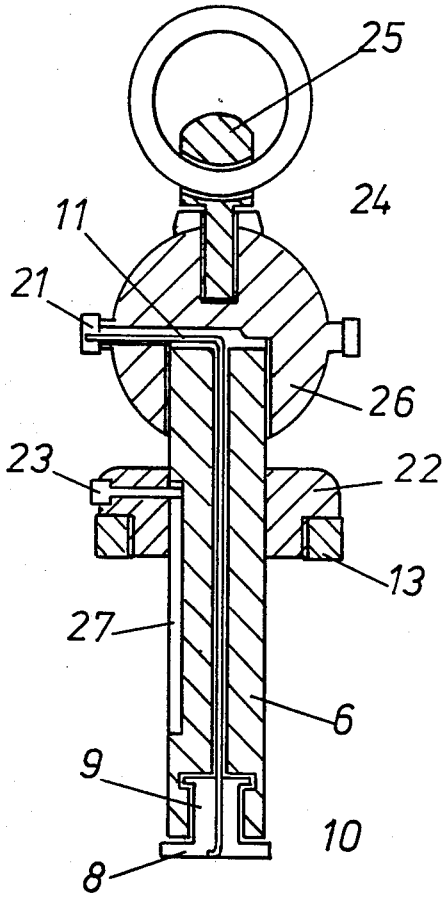
FIGS. 5 and 6 show sectional elevations of further mounting devices and accessories in accordance with the invention.
Figure 6:
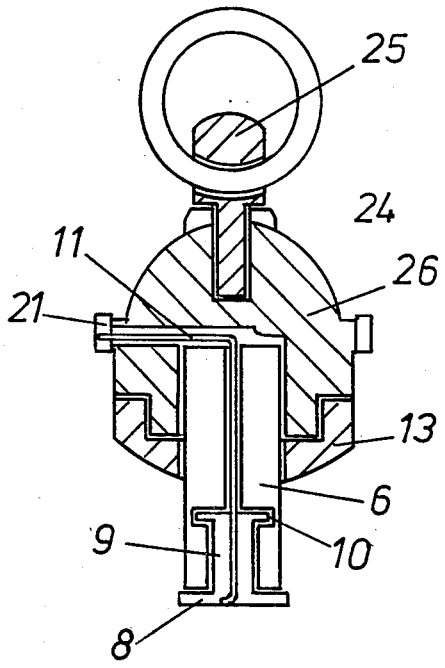

In FIGS. 5 and 6 are shown by way of example two accessories for providing anchorage points for safety harnesses but due to their general construction can be readily adapted to other forms of accessory. As far as possible in FIGS. 5 and 6 the same reference numerals have been used in the previously described Figures to designate corresponding parts.

Referring to FIG. 5, the equivalent 26 of the platform 12 is in the form of a ball which is screwed on to the leg 6. The supplementary accessory in the form of a harness anchorage 25 threadedly engages in threaded bore 24 in the ball 26.

To vary the effective length of the leg 6 a collar 22 is provided which can slide up and down leg 6 to adjust it. It is locked in position by screw 23 engaging in groove 27. Thus the accessory can be locked in position either behind the standard star socket or in a boss as in FIG. 2. In both cases the plate 8 is used for locking and the collar 22 is positioned to locate on top of the winch, the ring 13 providing final tight clamping as in the accessory of FIG. 2.

The accessory of FIG. 6 is somewhat similar to that of FIG. 5 in that the equivalent of the platform 12 is generally of ball shape, the ball shape being completed by the clamping ring 13.

In both FIGS. 5 and 6 angular movement of the wire 11 is effected by a ring 21 to which the free end of the wire is attached and which is located on the ball 26 so that it can be moved around it.

As can be readily appreciated the supplementary accessory 25 can take other forms. For example, it could take the form of a camera mounting platform which screws into bore 24.

Figure 9:
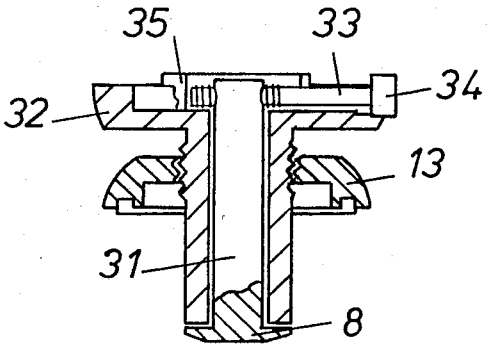
FIG. 9 is a sectional view in the line A—A of FIG. 8.
Figure 7:
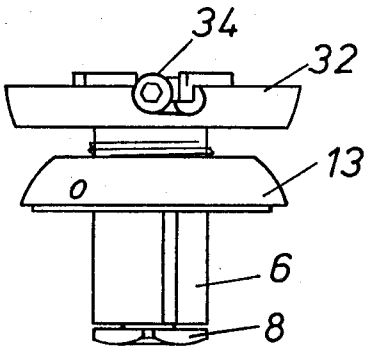
FIG. 7 shows a side elevational view of a still further accessory mounting device in accordance with the invention.
Figure 8:
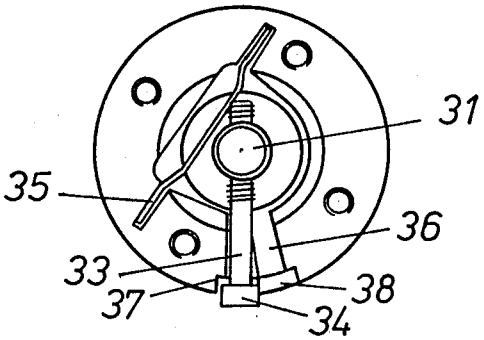
FIG. 8 is a plan view of the device of FIG. 7.

Referring now to FIGS. 7 to 9 a further accessory mounting device in accordance with the invention is shown. As far as possible the same reference numerals have been used in FIGS. 7 to 9 as in the earlier Figures to designate corresponding parts.

The mounting device has a leg 6, locking plate 8 and clamping member 13. However, in this embodiment the plate 8 is formed integrally with a steel post 31 which extends through the leg 6 into a recess in the plate 32. A threaded pin 33 engages in a threaded bore in the upper end of the post 31. At one end the pin 33 has a head 34 for effecting angular movement of the pin 33 to rotate the part 31 and hence the plate 8 to form a locking position. The pin 33 extends through the post 31 and at its inner end abuts against a spring 35. Thus the resistance to angular movement of the pin 33 can be adjusted by adjusting the distance the pin 33 is screwed into the post 31. As in the previous embodiments, the angular movement of the pin 33 is defined by the slot 36 in the upper surface of the plate 32. At its outer end this slot is recessed to provide two locations 37 and 38 for the head 34 of the pin 33. Thus, if the pin 33 is screwed in so far that the head 34 locates in one of these slots it prevents the pin 33 from being angularly displaced and this locks the plate 8 in one or other of its two positions.

In contrast to the previous embodiments in which a wire is connected to the plate 8 to provide its angular adjustment, the load bearing qualities of the embodiment of FIGS. 7 to 9 is far superior, since it uses a steel post 31 and steel pin 33. The use of the post 31 and pin 33 also has further advantages, namely 1. The pin 33 can be screwed in and out to adjust return tension of spring 35.
2. The pin 33 can be screwed in so that the head 34 is locked in a set position.
3. The pin can be unscrewed and removed to allow fitting of a different length post 31.
4. If the mounting device becomes jammed in the winch, removal of the pin 33 allows disassembly of the device.

Figure 10:
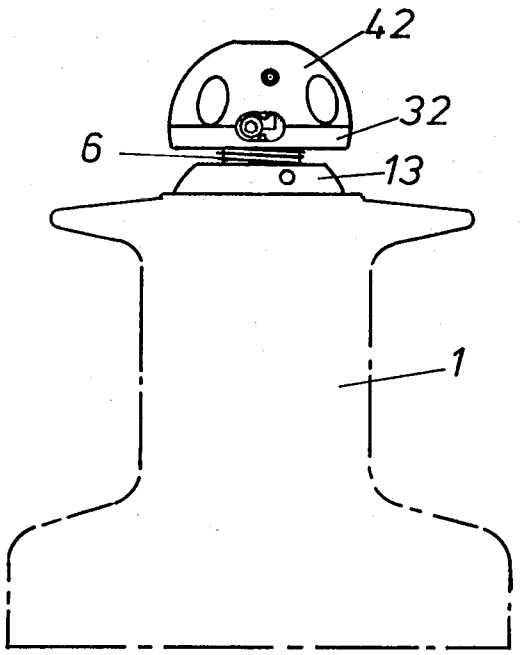
FIGS. 10 and 11 show the device of FIGS. 7 to 9 mounted in different ways in a winch.

The clamping ring 13 in this embodiment is of cap shape with an 'O' ring mounted in its rim for engaging with the top of a winch barrel as shown in FIG. 10.

If it is desired that the winch socket shall be allowed to turn, for example when the accessory mounted on the device is a searchlight, then the clamping ring 13 can be inverted so that its smaller face clamps against the winch socket 40. Alternatively, the ring 13 can be fitted in the manner shown in FIG. 11 simply to take up slack if a positive rotation preventing arrangement as shown in FIG. 2 is used.

Figure 11:
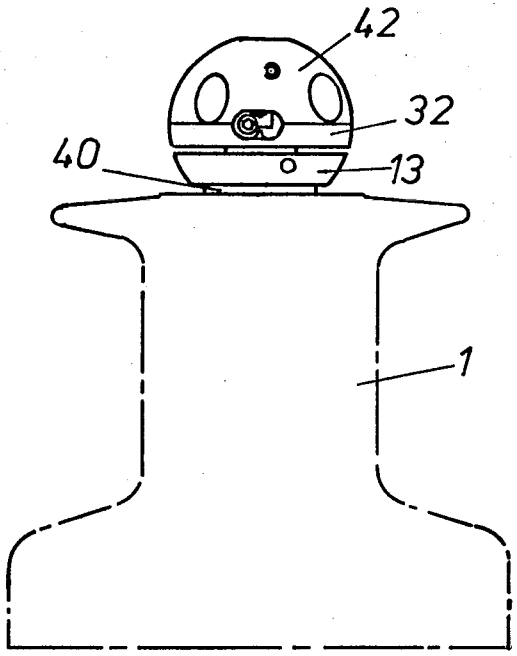

In FIGS. 10 and 11 a substantially spherical head 42 is shown mounted on the plate 32. This is secured to the plate 32 by screws which pass through the screw holes 43 (FIG. 8) from below the plate 32 and screw into the head 42. This head is designed to mount certain types of accessories.

Figure 12:
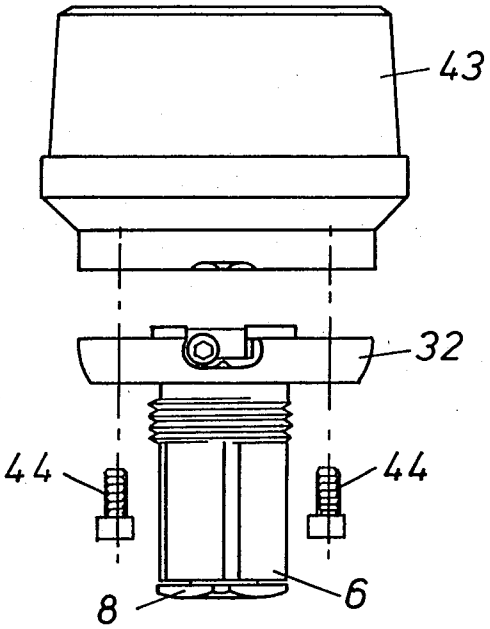

FIG. 12 again shows the device of FIGS. 7 and 9 but with a different accessory mounting head 45 and screws 44 for securing the head 45 to the plate 32.

Figure 13:
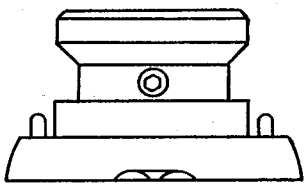
FIGS. 12 and 13 show the device of FIGS. 7 to 9 and various accessory mounting heads.

FIG. 13 shows yet a further form of accessory mounting head for securing to the plate 32.

I claim:

1. A mounting device capable of rigidly mounting an accessory or one of a range of accessories on a yacht, comprising;

(a) mounting means for the accessory, (b) a supporting leg depending from said mounting means and adapted to locate in the handle receiving socket of a winch, (c) a locking device provided on said support leg and by which the mounting means can be releasably locked in the winch socket, said locking device comprising a plate of the same shape and dimensions as the cross-section of said leg and which can be dis-placed from a first position in which it does not extend beyond the cross-section of the leg and so permits insertion of the leg into said socket, to a second position in which it projects laterally from said cross-section to effect locking of said leg in said socket, (d) a post integral with said plate and extending along the inside of said leg, (e) a pin which extends transversely through said post whereby by angular movement of said pin about the axis of said post, said post can be rotated within said leg to move said plate between said first and second positions, and (f) a clamping member threadedly engaging with the outside of said leg whereby after said mounting device has been locked in the winch said clamping member can be adjusted by screwing it down said leg to engage the winch and so take up any slackness in the mounting of the mounting device to the winch.

2. A mounting device according to claim 1, wherein said pin extends at one end through a slot in said mounting means the ends of the slot defining the limits of angular displacement of said pin and so define said first and second positions.

3. A mounting device according to claim 2, wherein said pin threadedly engages said post and at its other end abuts against a spring whereby the amount said pin is screwed through said post adjusts the resistance of the angular displacement of said pin.

4. A device according to claim 2 wherein said pin threadedly engages said post and has a head which when the pin is screwed in to said post becomes positioned in locations in said slot so that it is locked in a set angular position.

5. A device according to claim 1 wherein said clamping member can be mounted in a first orientation on said leg and in a second, inverted orientation and has one surface shaped so that it engages the upper surface of the winch socket when mounted in said one orientation on the supporting leg and an opposing surface which is recessed so that when it is mounted on said supporting leg in said inverted orientation it engages the winch at a position beyond the socket.

* * * * *